US008033201B2

(12) United States Patent
Cutler

(10) Patent No.: US 8,033,201 B2
(45) Date of Patent: Oct. 11, 2011

(54) SIGNALING TORQUE DRIVER AND METHOD

(76) Inventor: Brain James Cutler, Rowland Heights, CA (US)

( * ) Notice: Subject to any disclaimer, the term of this patent is extended or adjusted under 35 U.S.C. 154(b) by 0 days.

(21) Appl. No.: 12/189,688

(22) Filed: Aug. 11, 2008

(65) Prior Publication Data

US 2009/0049962 A1 Feb. 26, 2009

Related U.S. Application Data

(60) Provisional application No. 60/955,200, filed on Aug. 10, 2007.

(51) Int. Cl.
*B25B 23/159* (2006.01)

(52) U.S. Cl. ..... 81/467; 81/483

(58) Field of Classification Search ..... 81/467, 81/478, 483, 477, 480, 481
See application file for complete search history.

(56) References Cited

U.S. PATENT DOCUMENTS

| | | | | | |
|---|---|---|---|---|---|
| 724,545 | A | * | 4/1903 | Conklin | 446/415 |
| 2,172,561 | A | * | 9/1939 | Kruse | 81/483 |
| 3,140,623 | A | * | 7/1964 | Van Hoose | 81/483 |
| 4,898,068 | A | * | 2/1990 | Neuhaus | 81/483 |
| 5,156,072 | A | * | 10/1992 | Muralidharan | 81/478 |

* cited by examiner

*Primary Examiner* — Hadi Shakeri
(74) *Attorney, Agent, or Firm* — James A Italia; Italia IP

(57) ABSTRACT

A signaling torque driver that includes a casing assembly with a grip portion, a click arm with a fastener-engaging portion that projects from said casing assembly at one end and operably coupled to a torque-limiting means housed within said casing assembly at the other, torque-adjusting means within said casing assembly and coupled to said torque-limiting means for adjusting the torque-limiting means to a desired torque value, audible signaling means operably coupled with said torque-limiting means and/or visual signaling means operably coupled with said torque-limiting means such that an audible and visual indicator is activated to signal that the desired torque has been reached.

2 Claims, 5 Drawing Sheets

SIGNALING TORQUE DRIVER AND METHOD

CROSS-REFERENCE TO RELATED APPLICATION

This application claims the benefit of the filing date under 35 USC 119(e) of the filing date of U.S. Provisional Application Ser. No. 60/955,200, filed Aug. 10, 2007 and pursuant to 37 CFR 1.7, this application is considered timely as Aug. 10, 2008 fell on Sunday.

BACKGROUND

This application relates generally to driving tools such as screwdrivers, nut drivers, bolt drivers, wrenches and the like wherein the amount of torque that the tool can apply to a given fastener is limited to a settable value and the user is given a signal or indication that the desired torque level has been obtained. More specifically, this application relates to torque signaling mechanisms, both visual and audible, usable in said tools that identifies when the desired torque is reached, thereby preventing the user from overtorquing a given fastening device.

This application relates to drivers that are able to give a user an improved signal that a desired torque level has been reached and is designed for uses where torque tolerances are critical. The need for a torque driver that can drive a given fastener at a desired torque value is useful in a variety of fields including sporting goods, electronics and computer assembly, and any other use where specific tolerances are required. However, it would be desirable if there were a tool that would allow a user an improved indication that the desired torque level has been obtained such that each time a fastener was torqued, the user was confident that the desired torque was properly obtained. It would also be desirable for such a tool to be low-cost and suitable for mass production without sacrificing precision.

SUMMARY

This application discloses a signaling torque driver that is economical to produce, of simple construction and capable of mass production, but also capable of providing a clear indication to a user that the desired torque level has been obtained.

In particular, this application discloses a signaling torque driver that includes a casing assembly with a grip portion, a click arm with a fastener-engaging portion that projects from said casing assembly at one end and operably coupled to a torque-limiting means housed within said casing assembly at the other, torque-adjusting means within said casing assembly and coupled to said torque-limiting means for adjusting the torque-limiting means to a desired torque value, audible signaling means operably coupled with said torque-limiting means such that an audible indicator is activated to signal that the desired torque has been reached.

This application also discloses a signaling torque driver that includes a casing assembly with a grip portion, a click arm with a fastener-engaging portion that projects from said casing assembly at one end and operably coupled to a torque-limiting means housed within said casing assembly at the other, torque-adjusting means within said casing assembly and coupled to said torque-limiting means for adjusting the torque-limiting means to a desired torque value, visual signaling means operably coupled with said torque-limiting means such that a visual indicator is activated to signal that the desired torque has been reached.

In a further embodiment, this application discloses a signaling torque driver that includes a casing assembly with a grip portion, a click arm with a fastener-engaging portion that projects from said casing assembly at one end and operably coupled to a torque-limiting means housed within said casing assembly at the other, torque-adjusting means within said casing assembly and coupled to said torque-limiting means for adjusting the torque-limiting means to a desired torque value, audible signaling means operably coupled with said torque-limiting means, visual signaling means operably coupled with said torque-limiting means such that an audible and visual indicator is activated to signal that the desired torque has been reached.

In a further embodiment, this application discloses a method for signaling when a desired torque setting has been obtained by providing a signaling torque mechanism coupled to a click arm and housed within a casing assembly and coupled to a torque-limiting mechanism, setting a torque-adjusting mechanism coupled to said torque-limiting mechanism, and applying a force to the fastener engaged driver thereby activating the signaling torque mechanism.

Further, this application discloses a signaling torque driver that includes a casing assembly with a grip portion, a click arm with a fastener-engaging portion that projects from said casing assembly at one end and operably coupled to a torque-limiting means housed within said casing assembly at the other, torque-adjusting means within said assembly and coupled to said torque-limiting means for adjusting the torque-limiting means to a desired torque value, signaling torque means operably coupled with said click arm such that an indicator is activated to signal that the desired torque has been reached and wherein the fastener-engaging portion is further characterized by having orientation means such that driver is always in the correct orientation which allows the user to tighten the fastener while taking advantage of the desired torque-limiting and signaling torque means.

BRIEF DESCRIPTION OF THE DRAWINGS

The drawings, when considered in connection with the following description, are presented for the purpose of facilitating an understanding of the subject matter sought to be protected.

DETAILED DESCRIPTION

Figure 1:
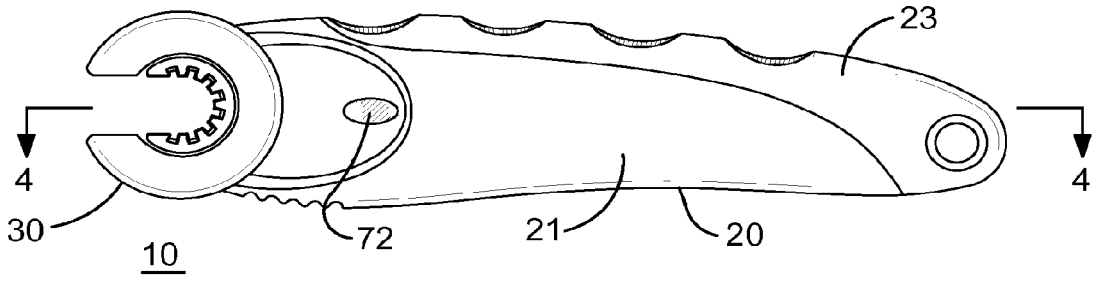
FIG. 1 is a top plan view of a signaling torque driver.
Figure 2:
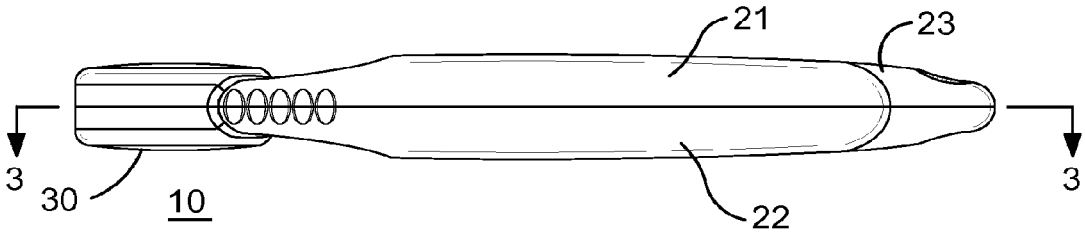
FIG. 2 is a side e view of the driver FIG. 1.

Referring to FIGS. 1-5, shown therein and generally designated by the reference character 10 is the preferred embodiment of the signaling torque driver 10 constructed in accordance with the following description. The driver 10 includes a casing assembly 20, a fastener-engaging portion 30, a torque-limiting mechanism 40, an adjusting mechanism 50, an audible signaling mechanism 60, and/or a visual signaling mechanism 70.

Figure 5:
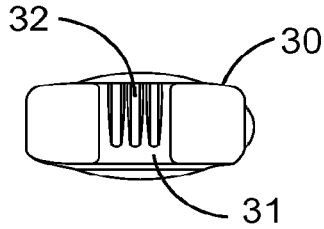
FIG. 5 is a front view of the fastener-engaging portion of the driver in FIG. 1.
Figure 8:
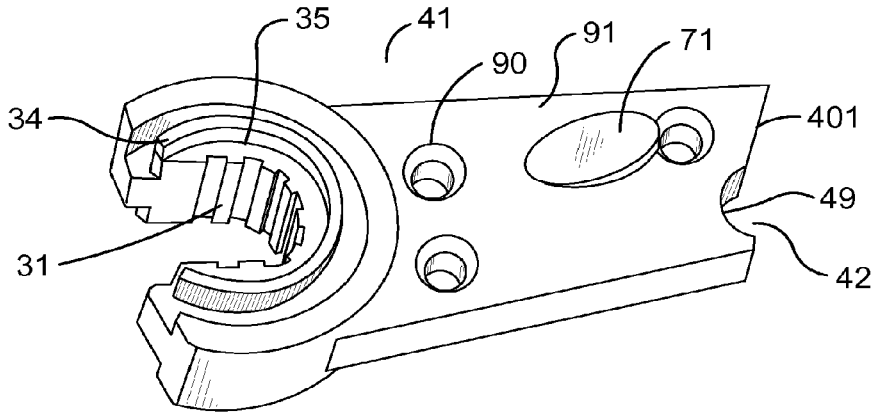
FIG. 8 is a perspective view of a second embodiment of a fastener-engaging portion.

As may be seen more clearly in FIGS. 5 and 8, the fastener-engaging portion 30 is adapted to engage a fastener (not shown), and includes a shaped inner surface 31 adapted to mateably receive a fastener. The inner surface 31 may include driver orientation means such as channels 32 that in one embodiment only span a portion of the inner surface 31 such that the driver can only engage a fastener in one direction and ensures that driver is in the correct orientation when the operator attaches it to a given fastener. See FIG. 5. In a second embodiment 33, the upper surface 34 of the fastener-engaging portion 30 may include driver orientation means such as an orientation limiting rim 35 that ensures that driver is in the correct orientation when the operator attaches it to a given fastener. The correct driver orientation allows the user to tighten the fastener while taking advantage of the desired torque-limiting and signaling means. The fastener-engaging portion 30 is integral with a click arm 41 and extends into and sits within the casing assembly 20. The casing assembly 20, which includes top and lower portions 21 and 22 and a grip portion 23 and forms the handle portion of the driver, remains stationary as the fastener-engaging portion 30 is maintained between and is able to pivot within the channels 24 of the top and lower portions 21 and 22. The distal end of the click arm 41 is operably associated with the torque-limiting mechanism 40 as discussed in more detail below.

Figure 3:
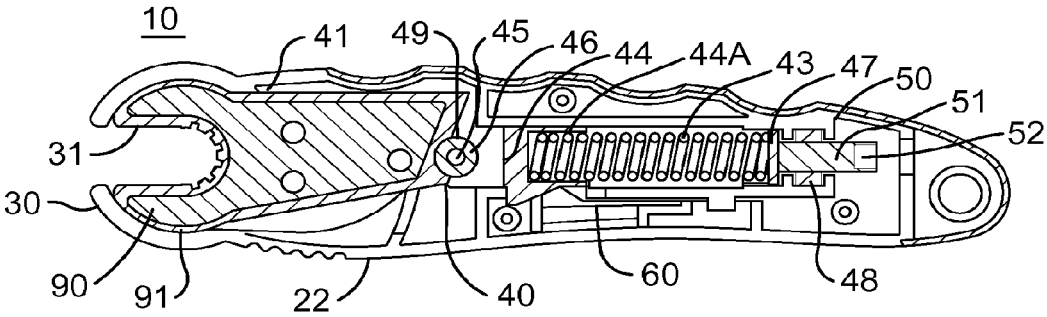
FIG. 3 is a sectional view of the driver taken generally along the line 3-3 in FIG. 2.
Figure 4:
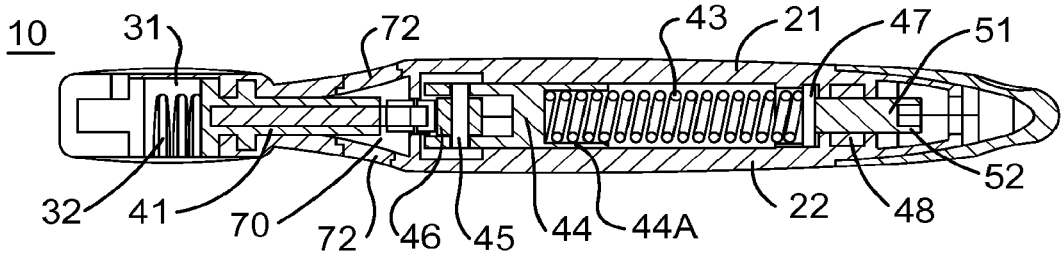
FIG. 4 is a sectional view of the driver taken generally along the line 4-4 in FIG. 1.
Figure 6:
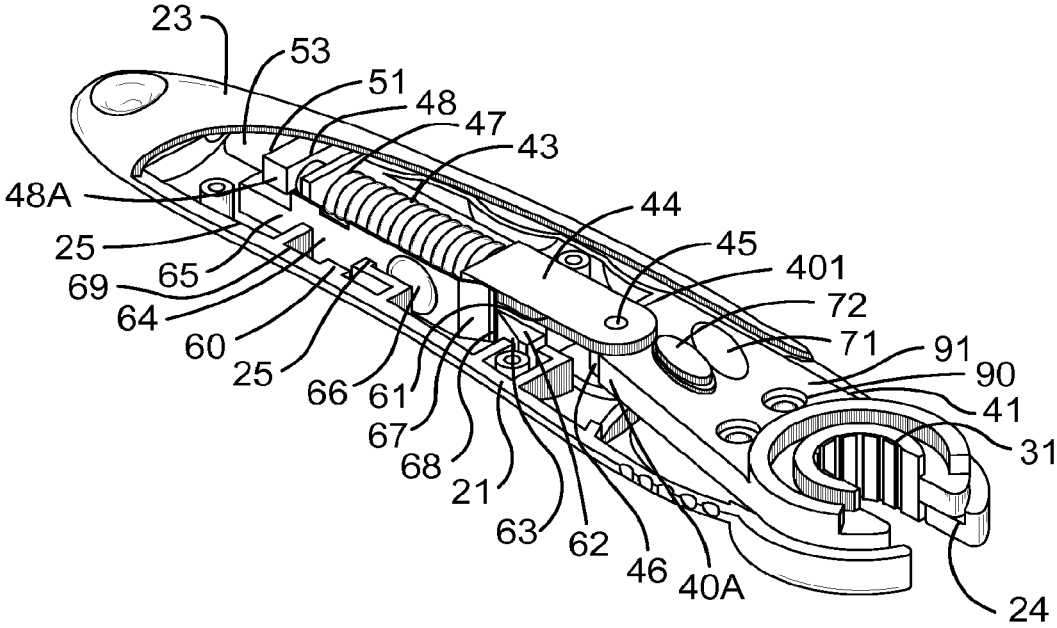
FIG. 6 is a cut-away perspective view of the driver in FIG. 1.
Figure 7:
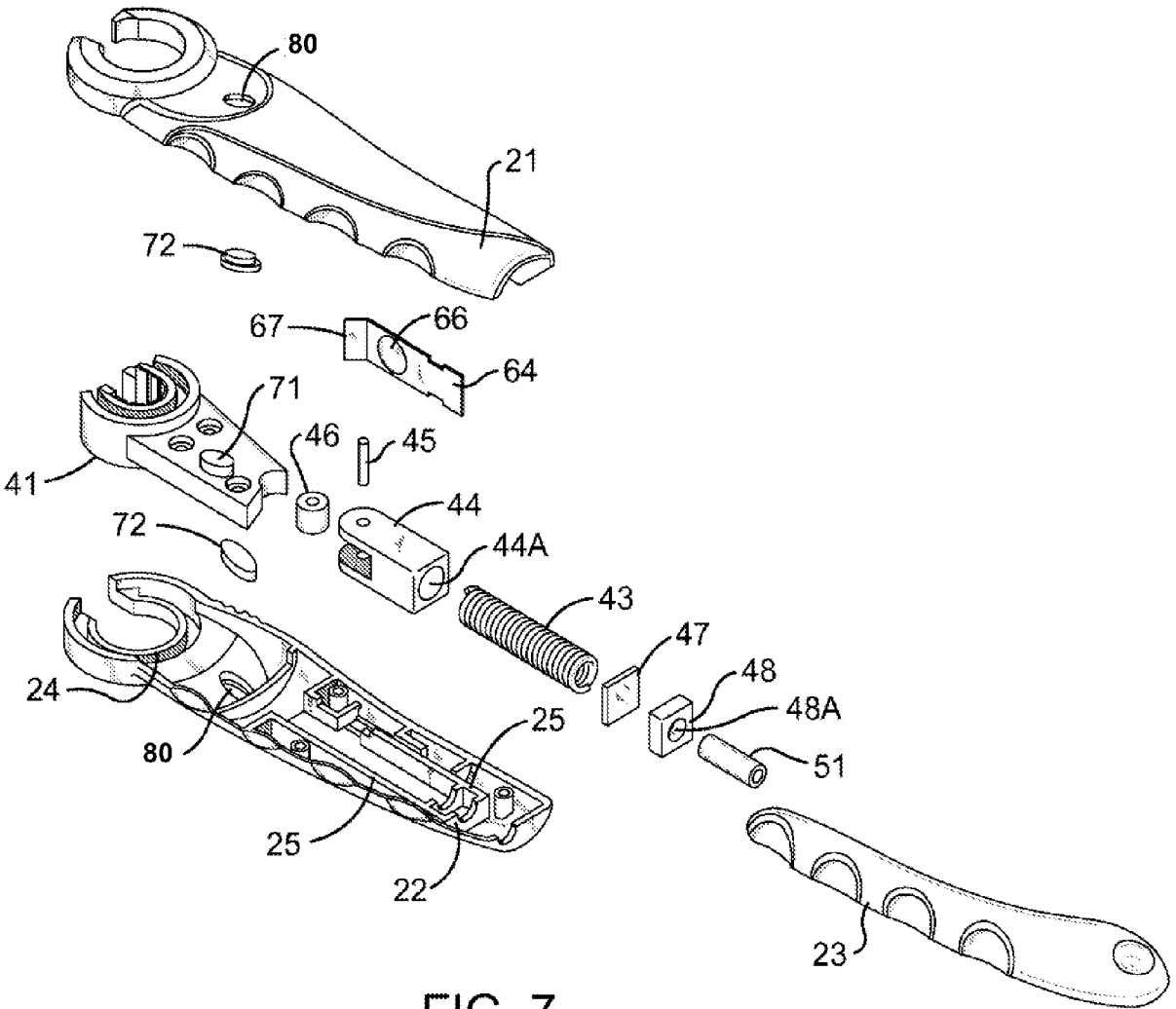
FIG. 7 is an exploded view of the driver in FIG. 1.
Figure 10:
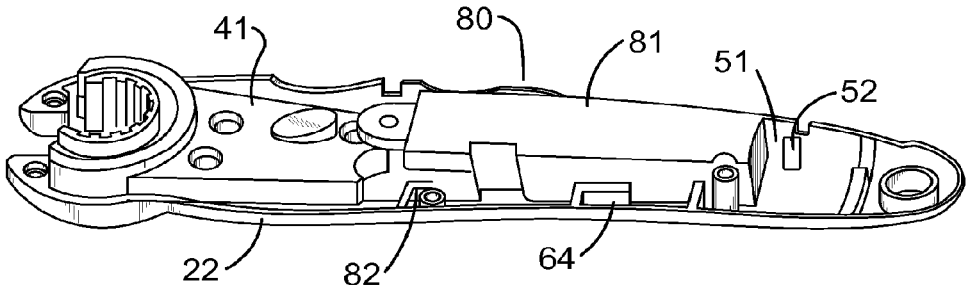
FIG. 10 is a cut-away perspective view of a second embodiment of the signaling torque driver; and, FIG. 11 is an isolated sectional view of the driver in FIG. 10.
Figure 11:
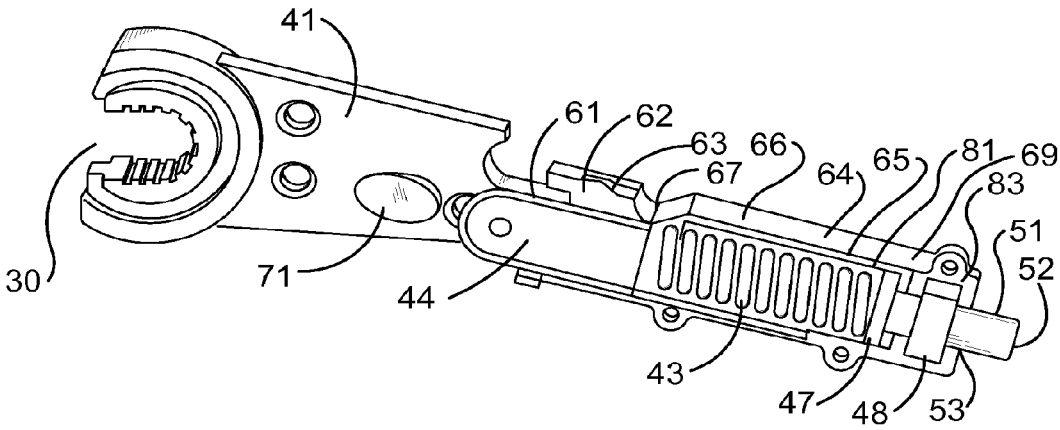

As may be seen more clearly in FIGS. 3, 4 and 6, the torque-limiting mechanism 40 disposed within the casing assembly 20 includes a click arm 41 with its cam surface 42, a spring 43, a cam follower 44 with its pin 45 and roller 46, a shim 47, a locking nut 48, and an adjustment plug 51. The spring 43 is disposed between a recessed portion 44A of the cam follower 44 and the shim 47. The cam follower 44 includes a roller 46 mounted rotateably to said follower 44 body by means of a rotateable pin 45, and together with the spring 43, shim 47, locking nut 48, and adjustment plug 51 serves to create a force when the spring 43 is compressed on the cam follower 44 which engages the roller 46 into the distal end of the click arm 41, more specifically, the detent radius 49 of the click arm 41. The distal end of the click arm 41 also includes an angled edge 401 that receives the roller 46 when the force applied to the driver overcomes the force of the spring 43 upon the cam follower 44. Preferably, the click arm 41 includes a metal core 90 for strength and integrity and a moldable plastic like covering 91 about its surface and within the fastener-engaging portion 30 to help prevent damage to the fastener the driver 10 is engaged upon. The force is applied to the spring 43 by the adjustment plug 51 given it is threaded surface 53 and is received through a threaded bore 48A in the locking nut 48. As the plug 51 is rotated in a given direction, a force is applied to the shim 47 and the adjacent spring 43 is compressed (discussed more fully below). The locking nut 48 is held in position by utilizing inner surfaces 25 of the top and lower portions 21 and 22 of the casing assembly 20, such that the locking nut is mateably received and unable to rotate given the abutment to the inner surfaces 25. Alternatively, as shown in FIGS. 10 and 11, an inner casing assembly 80 may be utilized to house and maintain the integrity of the torque-limiting mechanism 40. As shown, the inner casing assembly 80 is substantially rectangular shaped and includes upper and lower portions 81 and 82 and is used to house a portion of the cam follower 44, the spring 43, the shim 47, the locking nut 48, and portion of the adjustment plug 51. The inner casing assembly 80 includes inner surfaces 83 that abut the surface of the locking nut 48 and hold it in place so that the desired torque can be set and maintained.

Figure 9:
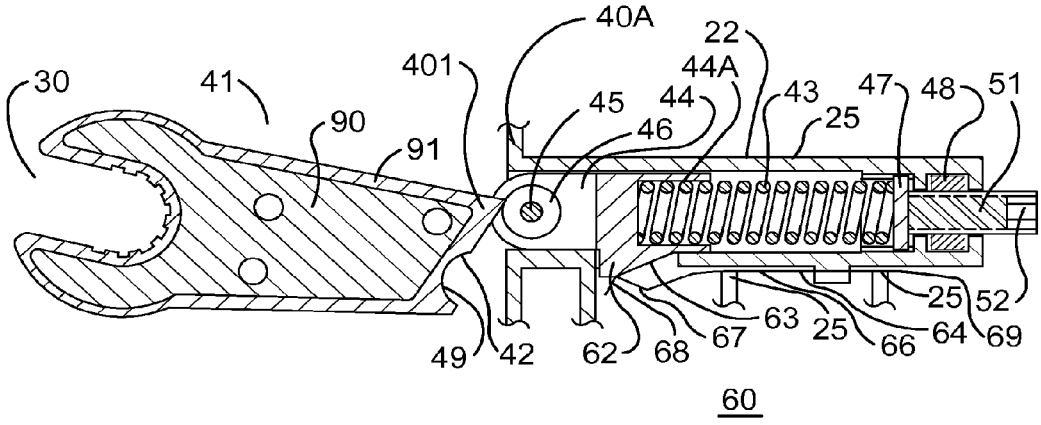
FIG. 9 is an isolated sectional view similar to the view in FIG. 3 shown under a force to activate the signaling mechanism.

The audible signaling mechanism 60 for signaling that the desired torque has been achieved on a given fastener is shown in FIGS. 6 and 9. The audible signaling mechanism 60 includes the cam follower 44 with a lateral surface 61 and a clicker cam 62 with an angled edge 63 integrated upon said surface 61, and a clicker 64. The clicker 64 includes a planer surface 65 and integrated therein a substantially circular convex surface 66 and a flanged portion 67 located at a first end 68. The convex surface 66 extends in an outward lateral direction relative to the spring 43. The second end 69 of the clicker 64 is held in position by utilizing the inner surfaces 25 of the top and lower portions 21 and 22 of the casing assembly 20, however, the first end 68 is left relatively unobstructed so that the first end 68 can be deflected a given distance. The audible signaling mechanism 60 then proceeds, briefly, as follows: As the click arm 41 is displaced due to a radial force on the grip portion 23 that exceeds the spring force on the cam assembly 40A (click arm 41 and cam follower 44), the first end 68 of the clicker 64 is deflected causing the convex surface 66 to depress and emanate a "click" sound. The clicker 64 is preferably made of thin metal materials so to provide enough flexibility for deflection and the "click" sound. When the force applied by the operator is lessened to a level below the spring force on the cam assembly 40A the clicker 64 returns back to its initial position. The audible signaling mechanism 60 is discussed more fully below.

In use, the adjustment of the driver 10 is accomplished by utilizing the adjusting mechanism 50, which includes the adjustment plug 51, which is characterized by having a socket 52 at its distal end that is mateably shaped to receive an adjustment tool (not shown) and further characterized by an annular externally threaded surface 53 that is mateably received by the internally threaded bore 48A of the locking nut 48. As the adjustment plug 51 is rotated to cause axial movement, this in turn creates an axial force on the torque-limiting mechanism; namely, the shims 47, and compression of the spring 43 against the cam assembly 40A. The spring 43 can be compressed to correspond to a desired torque limit. The torque limit of the driver 10 can be adjustable by a user or fixed at a specific setting once assembled. When a radial load is applied to the grip portion 23 in a direction perpendicular to the axis of the driver 10 and on a parallel plane consistent with the click arm 41 the torque moment force rises on the fastener engaged by the fastener-engaging portion 30 to the desired torque setting which causes the roller 46 to lift from the detent radius 49 and as more force is applied by the operator, onto the angled edge 401 (FIG. 9). As the torque applied by the user exceeds the force of the spring 43, and the roller 46 is lifted from the detent radius 49, the roller 46 begins to ride upon the angled edge 401 of the cam surface 42, which in turn causes cam follower 44 to be forced toward the distal end of the driver 10 as the spring 43 is compressed. As the cam follower 44 is forced to the distal end of the driver 10, the flanged portion 67 of the clicker 64 is forced upon the angled edge 63 of the clicker cam 62. This in turn causes the clicker 64 to deflect and the convex surface 66 to depress and emanate a "click" sound; thereby providing an audible indication that the applied load on the grip portion 23 has reached the desired torque setting of the driver 10. The angled edge 401 allows the click arm 41 to be forced by the roller 46 back to the start location in the detent radius 49 by the force of the spring 42 as the force against the grip portion 23 is reduced, thereby causing the cam follower 44 to return to its start location and the clicker 64 to return to its non-deflected state.

The visual signaling mechanism 70 for signaling that the desired torque has been achieved on a given fastener is shown in FIGS. 1 and 6. The visual signaling mechanism 70 utilizes a pair of indicators 71 located on opposite sides of the click arm 41. The indicators 71 may be colored so that they contrast with the color of click arm 41. The visual signaling mechanism 70 also includes a pair of windows 72 fixably attached within bores 80 on the upper and lower portions 21 and 22 of the casing assembly 20. In the resting state, the indicators 71 are hidden from view under the upper and lower portions 21 and 22 of the casing assembly 20. In operation (as described more fully above), when a radial load is applied to the grip portion 23 in a direction perpendicular to the axis of the driver 10 and on a parallel plane consistent with the click arm 41 the torque moment force rises on the fastener engaged by the fastener-engaging portion 30 to the desired torque setting which causes the roller 46 to lift from the detent radius 49 and as more force is applied by the operator, onto the angled edge 401 (FIG. 9). This causes the click arm 41 to deflect a given distance and the indicators 71 to now come in position under the windows 72 and thereby viewable to the operator; thereby indicating that the desired torque setting has been obtained.

While the present disclosure has been described in connection with what is considered the most practical and preferred embodiment, it is understood that that this disclosure is not limited to the disclosed embodiments, but is intended to cover various arrangements included within the spirit and scope of the broadest interpretation so as to encompass all such modifications and equivalent arrangements. To that end, various torque-limiting mechanisms are known in the prior art that are adaptable to the disclosed signaling means.

What is claimed is:

1. A signaling torque comprising:

a casing assembly with a grip portion;

a click arm with a fastener-engaging portion that projects from said casing assembly at one end and operably coupled to a torque-limiting means housed within said casing assembly at the other;

torque-adjusting means within said casing assembly and coupled to said torque-limiting means for adjusting the torque-limiting means to a desired torque value; and, audible signaling means operably coupled with said torque-limiting means such that an audible indicator is activated to signal that the desired torque has been reached;

wherein said torque limiting means includes a cam follower and a click arm, and the audible signaling means is a clicker mechanism operably coupled to said cam follower, and wherein the cam follower includes an angled edge and the clicker mechanism includes a clicker with a flanged portion, such that when a desired torque value is achieved, the angled edge engages the flanged portion of the cam follower and deflects the clicker, and wherein the clicker also includes a convex surface that becomes depressed when the clicker is deflected thereby emanating an audible signal that the desired torque is achieved.

2. A signaling torque driver comprising:

a casing assembly with a grip portion;

a click arm situated within said casing assembly, wherein said click arm includes a fastener-engaging portion at one end and operably coupled to a torque-limiting means housed within said casing assembly at the other, wherein fastener-engaging portion partially projects from said casing assembly and wherein the casing assembly remains stationary as the fastener engaging portion is able to rotate therebetween;

torque-adjusting means within said casing assembly and coupled to said torque-limiting means for adjusting the torque-limiting means to a desired torque value; fastener-engaging portion;

a fastener-engaging portion having orientation means such that driver is always in the correct orientation which allows the user to tighten the fastener while taking advantage of the desired torque-limiting and signaling torque means; and, signaling means operably coupled with said torque-limiting means such that an indicator is activated to signal that the desired torque has been reached;

wherein said torque limiting means includes a cam follower and a click arm, and the audible signaling means is a clicker mechanism operably coupled to said cam follower, and wherein the cam follower includes an angled edge and the clicker mechanism includes a clicker with a flanged portion, such that when a desired torque value is achieved, the angled edge engages the flanged portion of the cam follower and deflects the clicker, and wherein the clicker also includes a convex surface that becomes depressed when the clicker is deflected thereby emanating an audible signal that the desired torque is achieved.

* * * * *